US005351784A

United States Patent [19]

Sung

[11] Patent Number: 5,351,784

[45] Date of Patent: Oct. 4, 1994

[54] PROTECTIVE DEVICE FOR A SCAFFOLD

[76] Inventor: Te-Fu Sung, No. 179, Mu-Tan Rd., Mu-Tan Tsun, Mu-Tan Hsiang, Ping-Tung Hsien, Taiwan

[21] Appl. No.: 217,428

[22] Filed: Mar. 24, 1994

[51] Int. Cl.[5] ..... E04G 21/00

[52] U.S. Cl. ..... 182/138; 182/129

[58] Field of Search ..... 182/137–140, 182/129, 82

[56] References Cited

U.S. PATENT DOCUMENTS

| | | | |
|---|---|---|---|
| 4,074,791 | 2/1978 | Inman | 182/138 |
| 4,856,615 | 8/1989 | Nusbaum | 182/138 X |
| 5,299,654 | 4/1994 | Duncan | 182/138 |

*Primary Examiner*—Alvin C. Chin-Shue

*Attorney, Agent, or Firm*—Curtis, Morris & Safford

[57] ABSTRACT

A protective device mounted removably on a scaffold includes a pair of aligned connecting rod assemblies, each of which including an inclined inner rod, an inclined outer rod spaced apart from the inner rod so as to define a guideway between the inner and outer rods, and an inclined middle rod with a top end mounted on the scaffold and a bottom end mounted pivotally on the top ends of the inner and outer rods so as to allow turning of the middle rod downwardly into the guideway. The bottom ends of the inner and outer rods are mounted on the scaffold under the top end of the middle rod. The connecting rod assemblies are spaced apart from each other. A row of aligned and inclined coplanar protective assemblies are disposed side by side on the inner rods. Each of the protective assemblies includes an inclined sheet-like protective unit disposed on the inner rods so as to prevent building materials from falling into a space under the protective assembly, and two elongated retaining units secured on a bottom surface of the protective unit and retained respectively on the inner rods. Each of the retaining units includes a guide member engaged within the corresponding guideway. The protective assemblies can be removed one by one from the connecting rod assemblies.

4 Claims, 6 Drawing Sheets

PROTECTIVE DEVICE FOR A SCAFFOLD

BACKGROUND OF THE INVENTION

1. Field of the Invention

This invention relates to a protective device which can be mounted easily and removably on a scaffold so as to prevent building materials falling from the scaffold from hurting people under the protective device.

2. Description of the Related Art

Referring to FIGS. 1 and 2, a conventional protective device 1, which is mounted removably on a scaffold 2 so as to prevent building materials falling from the scaffold 2 from hurting people under the protective device 1, includes a pair of aligned connecting plate assemblies 10 (only one is shown in FIG. 1), two elongated positioning plates 11, two elongated support plates 12, four elongated retaining plates 13, and a rectangular protective net Each of the connecting plate assemblies 10 has an elongated base plate 101 which has a bottom end that is mounted pivotally on an outside portion of the scaffold 2 by means of a first pivot member 15, and an elongated pull plate 102 which has a bottom end that is connected to the top end of the base plate 101 and a top end that is mounted pivotally on the outside portion of the scaffold 2 by means of a second pivot member 16 (see FIG. 1) and that is located above the bottom end of the base plate 101 so as to position the connecting plate assemblies 10 on the scaffold 2. The connecting plate assemblies 10 are aligned with each other at a predetermined distance, Each of the connecting plate assemblies 10 has four noses 1010 that are mounted securely on the top surface of the base plate 101, Adjacent noses 1010 are spaced apart from each other at similar distances, Each of the noses 1010 on one of the base plates 101 is aligned with a respective one of the noses 1010 on the other one the base plates 101, Each of the positioning plates 11 has an L-shaped cross-section (see Fig, 1) and two sleeve holes (not shown) formed through two end portions thereof. One of the positioning plates 11 is positioned on the bottom end portions of the base plates 101 by sleeving the positioning plate 11 on the lowermost noses 100 the base plates 101 via the sleeve holes thereof. The other one of the positioning plates 11 is positioned on the top end portions of the base plates 101 in a similar manner. Each of the support plates has two sleeve holes (not shown) formed through two end portions thereof so as to permit positioning or the support plates 12 on the base plates 101 between the positioning plates 11 in a manner similar to that of the positioning plates 11, The protective net 14 has a bottom side portion disposed on the lowermost positioning plate 11, a top side portion disposed on the uppermost positioning plate 11, and two opposite side portions 140 (see FIG. 2), each of which having four sleeve holes (not shown) to permit sleeving of the net 14 on the noses 1010 so as to confine the net 14 between the base plates 101. The support plates 12 can support the protective net 14 when building materials fall on the protective net 14.

Each of the retaining plates 13 has two sleeve holes (not shown) formed through two end portions thereof to permit sleeving of the retaining plates 13 on the aligned noses 1010 on the base plates 101. Accordingly, the retaining plates 13 are fastened on the base plates 101 and are respectively located above the positioning and support plates 11, 12 so as to press against the protective net 14, thereby preventing removal of the protective net 14 from the base plates 101. Each of the noses 1010 has a pin hole (not shown) which is formed through an upper end portion thereof, and a pin 18 which engages the pin hole and which has two end portions that protrude through the pin hole in order to prevent removal of the retaining plate 13 from the corresponding noses 1010.

The drawbacks of the conventional prospective device 1 are as follows:

1. The conventional protective device 1 has many parts, such as the positioning plates 11, the support plates 12, the retaining plates 13, the protective net 14, the pins 18 etc.. Accordingly, the transport costs for these parts is relatively expensive.

2. Because these parts are separate from one another, it is inconvenient for a worker to assemble these parts to form the protective device 1 on the scaffold 2. Of course, it is also inconvenient for the worker to disassemble the protective device 1 from the scaffold 2.

3. When it is desired to mount these parts on the scaffold 2, the worker has to use a safety belt to support the worker's waist on the scaffold 2, thus permitting the worker to stand on the base plates 101 of the connecting plate assemblies 10 so as to mount these parts one by one on the base plates 101 in order to constitute the protective device 1. Such an operation, dangerous for the worker, more particularly when the protective device 1 is located at a relatively high position.

SUMMARY OF THIS INVENTION

The main objective of this invention is to provide a protective device which has a fewer number of parts so as to permit mounting of the same conveniently on a scaffold and so as to reduce the charge for transporting the protective device.

Another objective of this invention is to provide a protective device which, when mounted on a scaffold, requires a worker to stand on the scaffold during the assembly of the protective device, thereby avoiding exposure of the worker to dangerous working conditions.

According to this invention, a protective device, which is mounted removably on a scaffold so as to prevent building materials falling from the scaffold from hurting people under the protective device, includes a pair of aligned connecting rod assemblies, and a row of aligned and inclined coplanar protective assemblies which are disposed side by side on the connecting rod assemblies. Each of the connecting rod assemblies includes an inclined inner rod that has a first end and a second end, an inclined outer rod that is spaced apart from the inner rod at a predetermined distance so as to define a longitudinal guideway between the inner and outer rods and that has a first end connected securely to the first end of the inner rod and a second end connected securely to the second end of the inner rod, and an inclined middle rod that has a first end mounted removably on an outside portion of the scaffold and a second end mounted pivotally on and located between the second ends of the inner and outer rods so as to allow turning of the middle rod downwardly into the guideway when the first end of the middle rod is removed from the scaffold. The first ends of the inner and outer rods are mounted removably on the outside portion of the scaffold under the first end of the middle rod. The second end of the middle rod is disposed higher than the first ends of the inner and outer rods and lower than the first end of the middle rod. The connecting rod assemblies are spaced apart from each other at a predetermined distance. Each of the protective assemblies includes an inclined sheet-like protective unit which is disposed on the inner rods of the connecting rod assemblies so as to prevent the building materials which fall from the scaffold from falling into a space under the protective assembly, and two elongated retaining units which are mounted securely on a bottom surface of the protective unit and which are retained respectively on the inner rods of the connecting rod assemblies. Each of the retaining units includes a guide member secured thereto. Each of the guide members is engaged within a corresponding one of the guideways. Accordingly, when a lowermost one of the protective assemblies is removed from the connecting rod assemblies, remainder of the protective assemblies can slide downward on the inner rods so as to be removed one by one from the connecting rod assemblies.

BRIEF DESCRIPTION OF THE DRAWING

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
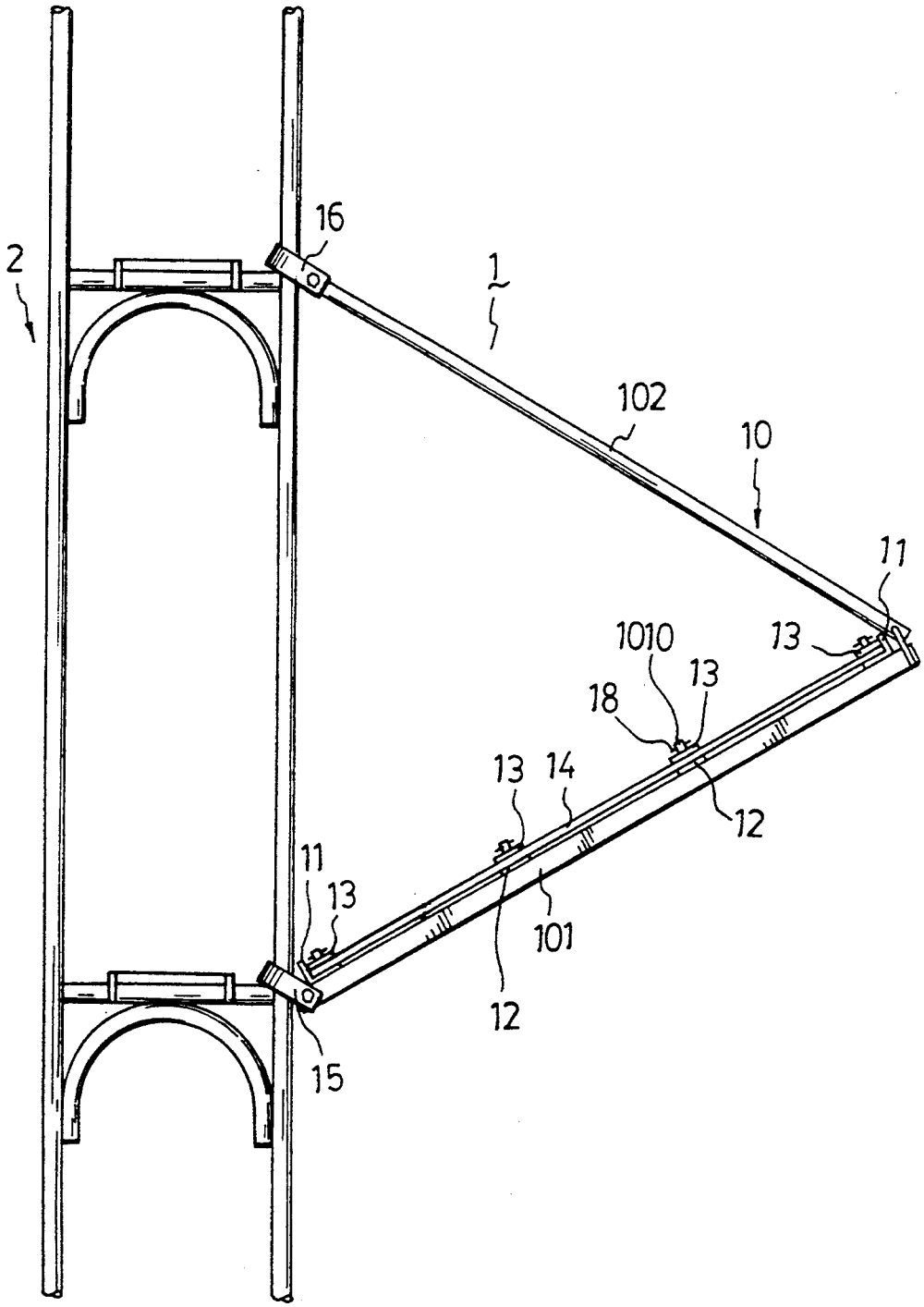
FIG. 1 PRIOR ART
FIG. 1 is a schematic view illustrating a conventional protective device which is mounted removably on a scaffold.
Figure 2:
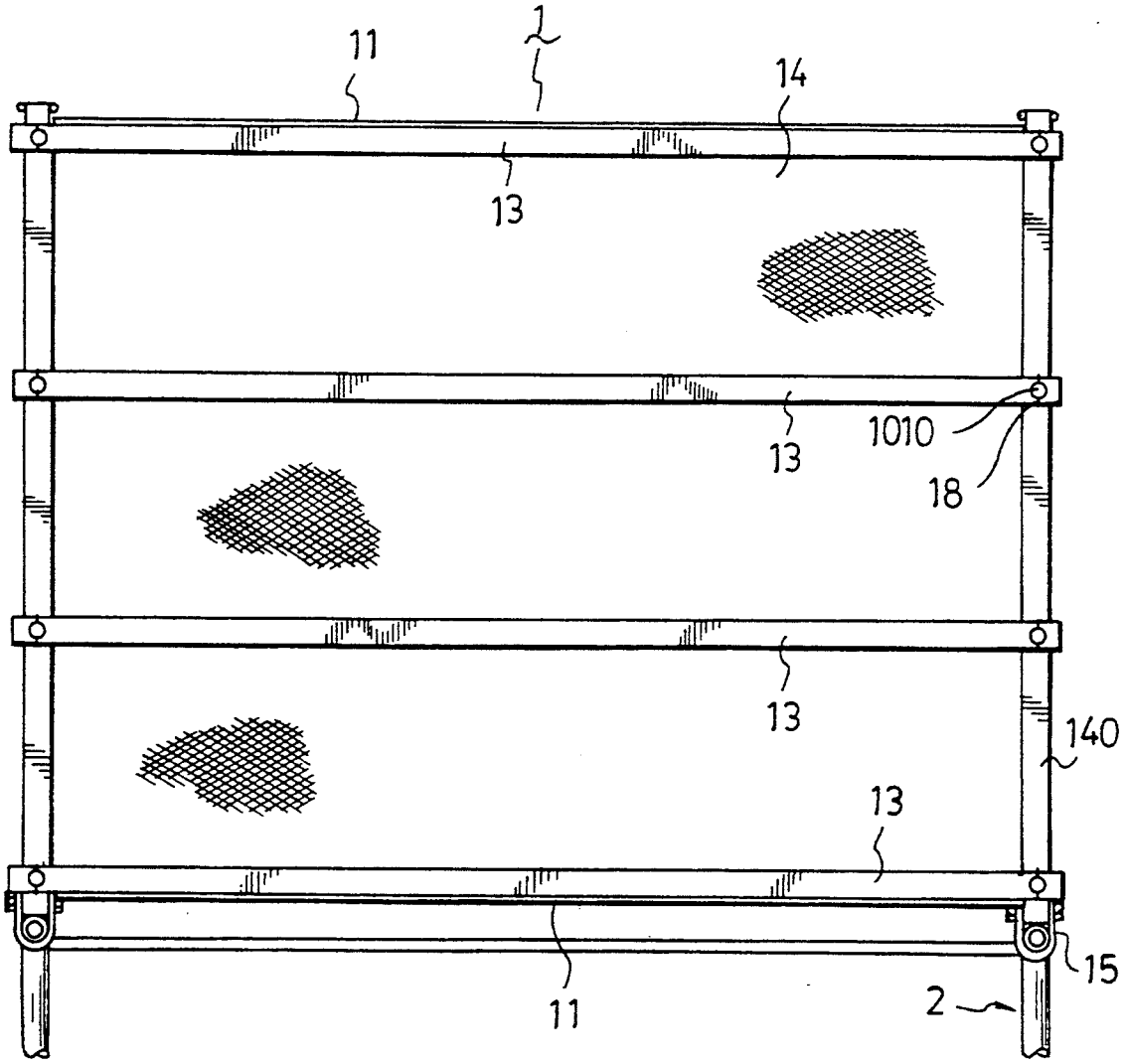
FIG. 2 PRIOR ART
FIG. 2 is a top elevational view illustrating how a protective net is positioned on two base plates the conventional protective device.
Figure 3:
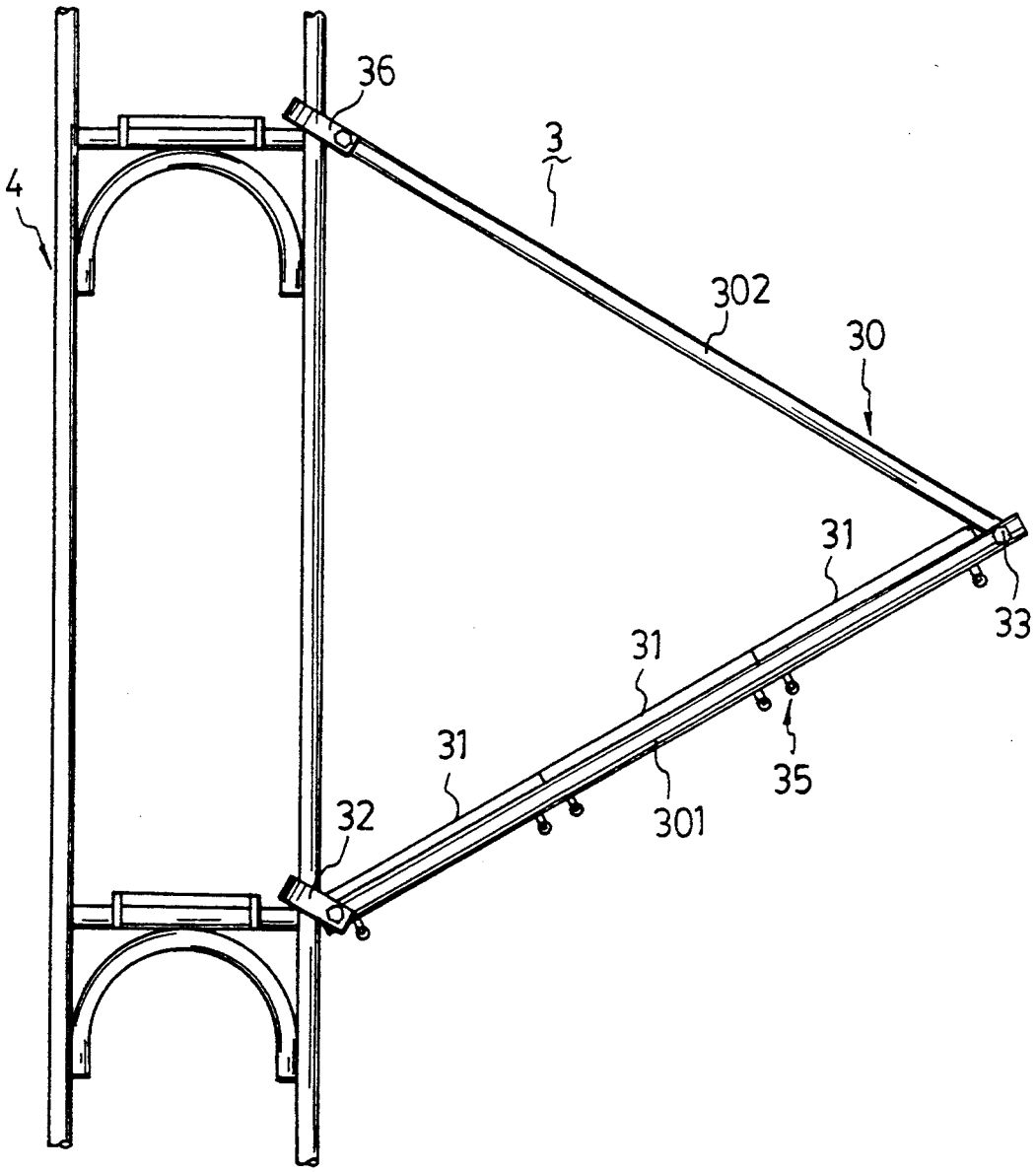
FIG. 3 is a schematic view illustrating a protective device of a preferred embodiment of this invention which is mounted removably on a scaffold.

Referring to FIG. 3, a protective device 3 of the preferred embodiment of this invention, which is mounted removably on a scaffold 4 so as to prevent building materials falling from the scaffold 4 from hurting people under the protective device 3, includes a pair of aligned connecting rod assemblies 30 (only one is shown) and three aligned and inclined coplanar protective assemblies 31 that are disposed side by side on the connecting rod assemblies 30.

Figure 4:
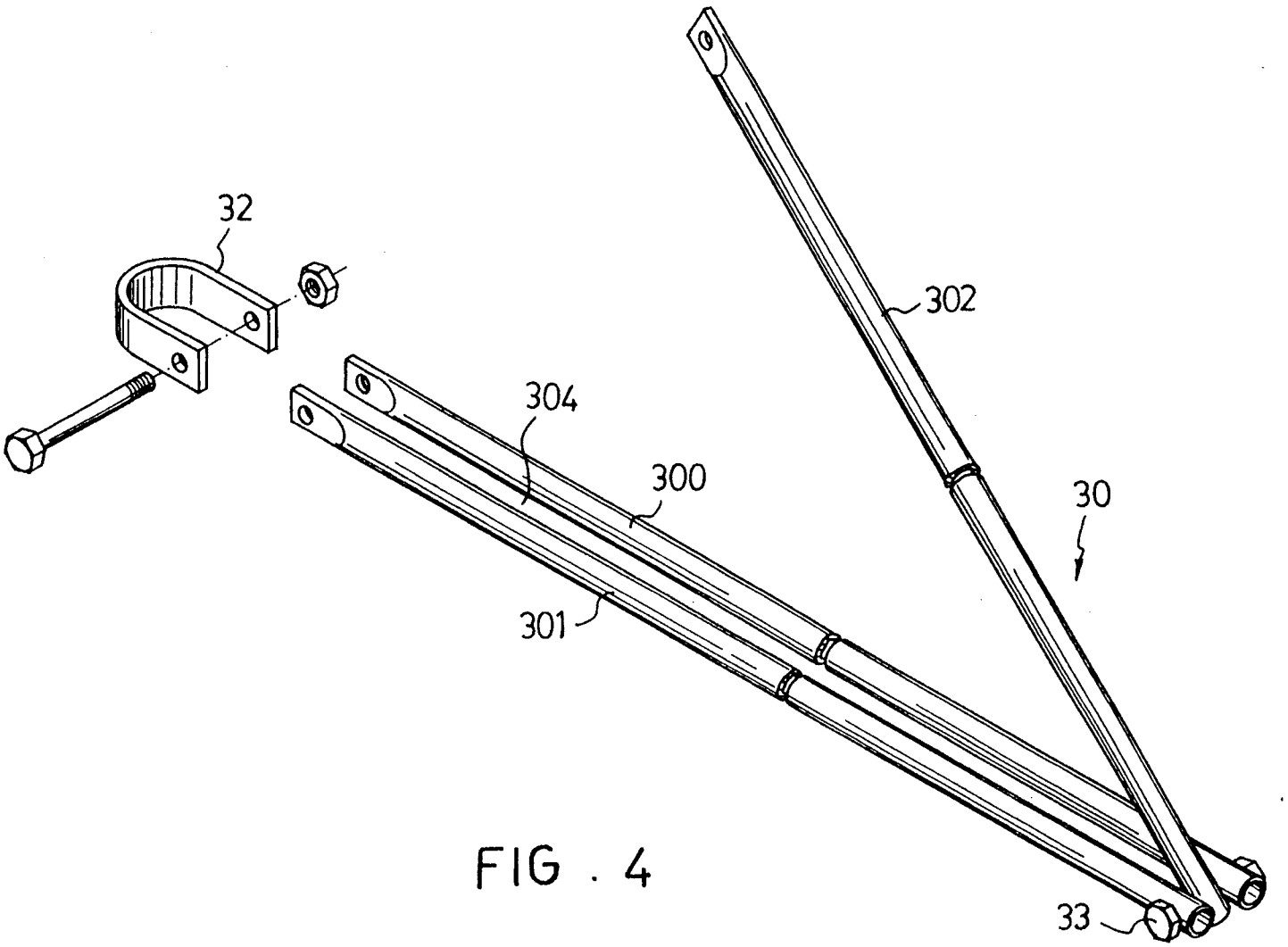
FIG. 4 is a perspective view showing one of the connecting rod assemblies of the protective device according to this invention.

Referring to FIGS. 3 and 4, each of the connecting rod assemblies 30 includes an inclined inner rod 300 (see FIG. 4) that has a first end and a second end, an inclined outer rod 301 that is spaced apart from the inner rod 300 at a predetermined distance so as to define a longitudinal guideway 304 (see FIG. 4) between the inner and outer rods 300, 301 and that has a first end which is connected securely to the first end of the inner rod 300 and a second end which is connected securely to the second end of the inner rod 300 by means of a shaft 33, and an inclined middle rod 302 that has a first end which is mounted removably on an outside portion of the scaffold 4 by means of a second fastening member 36 (see FIG. 3) in a known manner and a second end which is mounted pivotally on the shaft 33 and which is located between the second ends of the inner and outer rods 300, 301 so as to allow turning of the middle rod 302 downwardly into the guideway 304 when the first end of the middle rod 302 is removed from the scaffold 4. The first ends of the inner and outer rods 300, 301 are mounted removably on the outside portion of the scaffold 4 by means of a first fastening member 32 in a known manner and are located under the first end of the middle rod 32. The second end of the middle rod 302 is disposed higher than the first ends of the inner and outer rods 300, 301 and lower than the first end of the middle rod 302. The connecting rod assemblies 30 are spaced apart from each other at a predetermined distance, as shown in FIG. 6.

Figure 5:
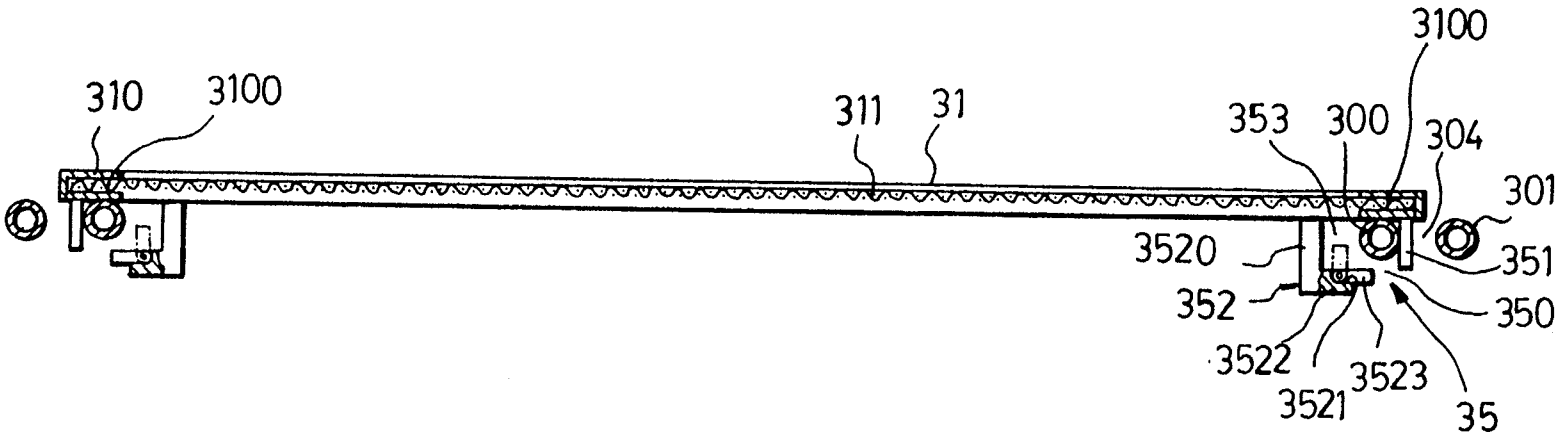
FIG. 5 is a partly sectional view illustrating one of the protective assemblies of the protective device which is retained on the inner rods of the connecting rod assemblies according to this invention.
Figure 6:
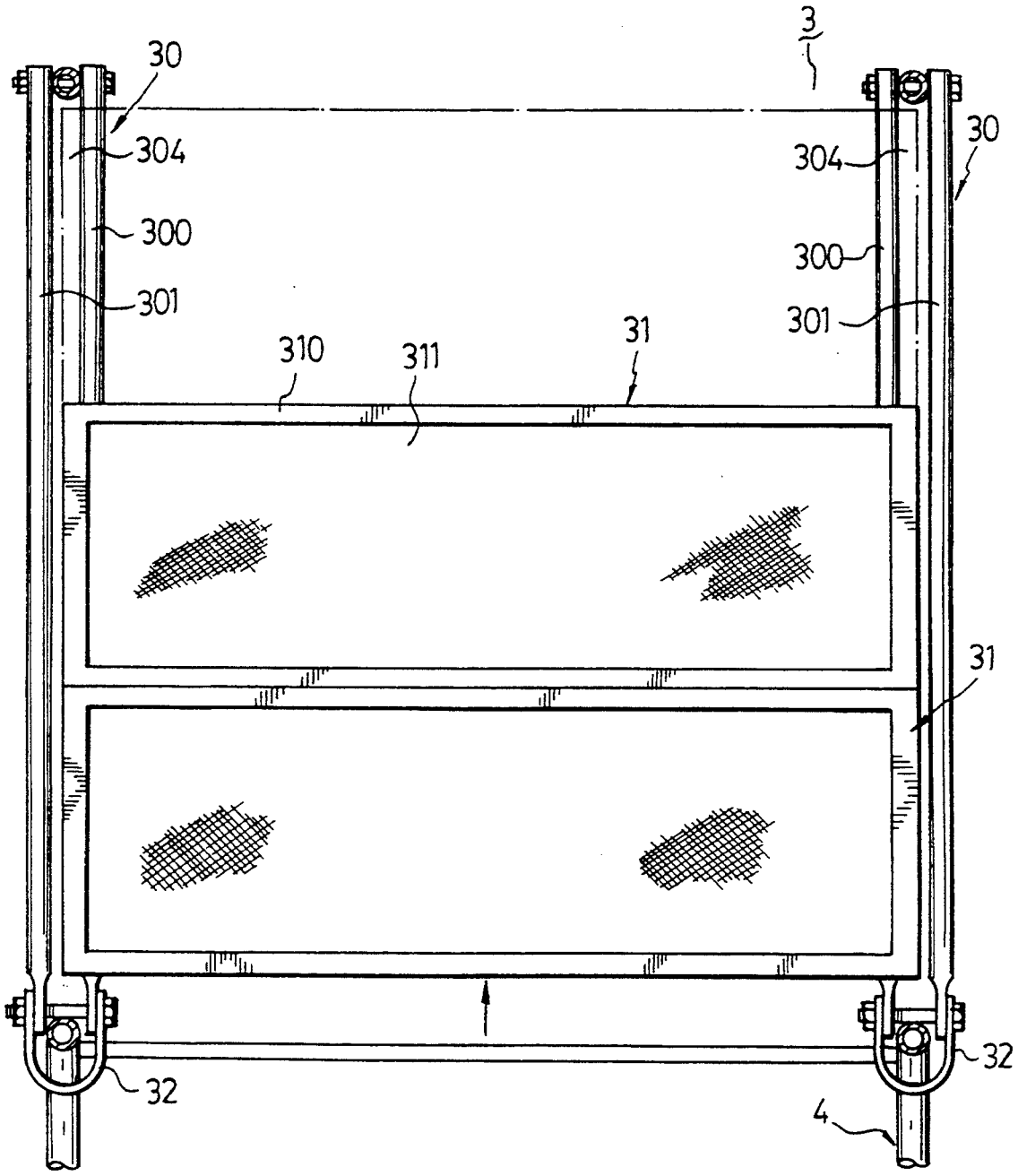
FIG. 6 is a schematic view illustrating how the protective assemblies are disposed side by side on the connecting rod assemblies in accordance with this invention.

Referring to FIGS. 5 and 6, each of the protective assemblies 31 includes an inclined sheet-like protective unit which is disposed on the inner rods 300 of the connecting rod assemblies 30 so as to prevent the building materials which fall from the scaffold 4 from falling into a space under the protective assembly 31, and two elongated retaining units 35 (see FIG. 5) which are mounted securely on a bottom surface of the protective unit and which are retained respectively on the inner rods 300 of the connecting rod assemblies 30.

The protective unit of each of the protective assemblies 31 includes a rectangular frame 310 which has two narrow-side portions that are disposed respectively on the inner rods 300 and two wide-side portions that interconnect the narrow-side portions so as to define an accommodating space among the wide- and narrow-side portions. Each of the narrow-side portions has a longitudinal first slot 3100 (see FIG. 5) formed in an inner surface thereof. The first slots 3100 face each other. Each of the wide-side portions has a longitudinal second slot (not shown) formed in an inner surface thereof. The second slots face toward each other. The protective unit of each of the protective assemblies 31 further includes a rectangular sheet-like protective member 311, such as a protective net or an asbestos slate etc., which is engaged within the first slots 3100 and the second slots of the rectangular frame 310 at side portions thereof so as to occupy the accommodating space within the rectangular frame 310.

Referring again to FIG. 5, each of the retaining units 35 of each of the protective assemblies 31 includes a guide member 351 which is mounted securely on the bottom surface of a respective one of the narrow-side portions of the rectangular frame 310 and which is engaged within a corresponding one of the guideways 304, and a longitudinal holding assembly 352 which includes a vertical plate 3520 that has two end portions mounted securely and respectively on the bottom surface of the wide-side portions of the rectangular frame 310 and that is spaced apart from the corresponding guide member 351 at a predetermined distance. The guide member 351 is a vertical plate so that the guide member 351 and the vertical plate 3520 of the holding assembly 352 define a receiving space 353 therebetween, in which a corresponding one of the inner rods 300 is confined. Accordingly, the protective assemblies 30 can slide on the inner rods 300 along the guideways 304. The holding assembly 352 of each of the retaining units 35 further includes a horizontal plate 3522 which has a side that is connected securely to the bottom end of the vertical plate 3520 so as to define a gap 350 between the distal end of the horizontal plate 3522 and the bottom end of the guide member 351. The gap 350 has a width larger than the diameter of the inner rod 300. The horizontal plate 3522 has a longitudinal guide groove 3521 formed in the top surface of an end portion thereof. The holding assembly 352 of each of the retaining units 35 further includes a horizontal retaining plate 3523 which is mounted pivotally in the guide groove 3521 of the horizontal plate 3522 and which extends into the gap 350 in such a manner that the retaining plate 3523 is spaced apart from the bottom end of the corresponding guide member 351 at a distance smaller than the diameter of the inner rod 300 so as to prevent removal of the retaining unit 35 from the inner rod 300. Accordingly, when the retaining plates 3523 of the retaining units 35 of the protective assemblies 31 are turned upwardly in a direction away from the gaps 350, the retaining units 35 can be separated from the inner rods 300 of the connecting rod assemblies 30 so as to permit removal of the protective assemblies 31 from the connecting rod assemblies 30. Accordingly, when the lowermost one of the protective assemblies 31 is removed from the connecting rod assemblies 30, the rest of the protective assemblies 31 can slide downward on the inner rods 300 of the connecting rod assemblies 31 so as to be removed one by one from the connecting rod assemblies 31.

Because the parts of the protective device 3 ,are assembled on the connecting rod assemblies 30 and the protective assemblies 31 before they are mounted on the scaffold 4, it is convenient for a worker to transport the protective devices 3 and to mount the same on the scaffold 4. Accordingly, the charge for transporting the protective device 3 is reduced. Preferably, according to the above-described manner, the worker only has to stand on the scaffold 4 when mounting the protective assemblies 31 on the connecting rod assemblies 30 by pushing the protective assemblies 31 upwardly one by one on the inner rods 300 of the connecting rod assemblies 30 so as to constitute the protective device 3.

With this invention thus explained, it is apparent that numerous modifications and variations can be made without departing from the scope and spirit of this invention. It is therefore intended that this invention be limited only as indicated in the appended claims.

I claim:

1. A protective device, which is to be mounted removably on a scaffold so as to prevent building materials falling from the scaffold from hurting people under said protective device, comprising:

a pair of aligned connecting rod assemblies each of which including an inclined inner rod that has a first end and a second end, an inclined outer rod that is spaced apart from said inner rod at a predetermined distance so as to define a longitudinal guideway between said inner and outer rods and that has a first end connected securely to said first end of said inner rod and a second end connected securely to said second end of said inner rod, and an inclined middle rod that has a first end to be mounted removably on an outside portion of said scaffold and a second end mounted pivotally on and located between said second ends of said inner and outer rods so as to allow turning of said middle rod downwardly into said guideway when said first end of said middle rod is removed from said scaffold, said first ends of said inner and outer rods to be mounted removably on said outside portion of said scaffold under said first end of said middle rod, said second end of said middle rod being disposed higher than said first ends of said inner and outer rods and lower than said first end of said middle rod, said connecting rod assemblies being spaced apart from each other at a predetermined distance; and a row of aligned and inclined coplanar protective assemblies disposed side by side on said inner rods of said connecting rod assemblies, each of said protective assemblies including an inclined sheet-like protective unit which is disposed on said inner rods of said connecting rod assemblies so as to prevent the building materials which fall from said scaffold from falling into a space under said protective assembly, and two elongated retaining units which are mounted securely on a bottom surface of said protective unit and which are retained respectively on said inner rods of said connecting rod assemblies, each of said retaining units including a guide member secured thereto, each of said guide members being engaged within a corresponding one of said guideways, thereby, when a lowermost one of said protective assemblies is removed from said connecting rod assemblies, remainder of said protective assemblies can slide downward on said inner rods so as to be removed one by one from said connecting rod assemblies.

2. A protective device as claimed in claim 1 wherein said protective unit of each of said protective assemblies includes a rectangular frame which has two narrow-side portions that are disposed respectively on said inner rods and two wide-side portions that interconnect said narrow-side portions so as to define an accommodating space among said wide- and narrow-side portions, each of said narrow-side portions having a longitudinal first slot formed in an inner surface thereof, said first slots facing each other, each of said wide-side portions having a longitudinal second slot formed in an inner surface thereof, said second slots facing each other, each of said protective units further including a rectangular sheet-like protective member which is engaged within said first and second slots of said rectangular frame at side portions thereof so as to occupy said accommodating space.

3. A protective device as claimed in claim 1, wherein each of said retaining units further includes a longitudinal holding assembly which is mounted securely on said bottom surface of said protective unit, said guide member and said holding assembly defining a receiving space therebetween, in which a corresponding one of said inner rods is confined, whereby/, said protective assemblies are inseparable from said inner rods.

4. A protective device as claimed in claim 3, wherein said holding assembly of each of said retaining units includes a vertical plate which is mounted securely on said bottom surface of said protective unit, and a horizontal plate which has a side secured to a bottom end of said vertical plate so as to define a gap between a distal end of said horizontal plate and a bottom end of said guide member, said gap having a width larger than a diameter of said inner rods, said horizontal plate having a longitudinal guide groove formed in a top surface of an end portion thereof, said holding assembly of each of said retaining units further including a horizontal retaining plate which its mounted pivotally in said guide groove of said horizontal plate and which extends into said gap in such a manner that said retaining plate is spaced apart from said bottom end of a corresponding one of said guide members at a distance smaller than the diameter of said inner rods so as to prevent removal of said retaining units from said inner rods;

whereby, when said retaining plates of said retaining units of said protective assemblies are turned upwardly in a direction away from said gaps, said retaining units can be removed from said inner rods of said connecting rod assemblies so as to permit removal of said protective assemblies from said connecting rod assemblies.

* * * * *

UNITED STATES PATENT AND TRADEMARK OFFICE

CERTIFICATE OF CORRECTION

PATENT NO. : 5,351,784

DATED : October 4, 1994

INVENTOR(S) : Te-Fu Sung

It is certified that error appears in the above-identified patent and that said Letters Patent is hereby corrected as shown below:

Claim 1, column 6, line 25, please change "thereby" to --whereby--.

Claim 2, column 6, line 31 after "claim 1" insert --,--.

Claim 3, column 6, line 54, after "whereby" delete "/".

Signed and Sealed this

Fifteenth Day of November, 1994

*Attest:*

*Attesting Officer*

BRUCE LEHMAN

*Commissioner of Patents and Trademarks*